US005181453A

United States Patent [19]

Kayukawa et al.

[11] Patent Number: 5,181,453

[45] Date of Patent: Jan. 26, 1993

[54] VARIABLE DISPLACEMENT COMPRESSOR

[75] Inventors: Hiroaki Kayukawa; Kazuya Kimura; Kenji Takenaka; Takuya Okuno, all of Kariya, Japan

[73] Assignee: Kabushiki Kaisha Toyoda Jidoshokki Seisakusho, Kariya, Japan

[21] Appl. No.: 780,140

[22] Filed: Oct. 21, 1991

[30] Foreign Application Priority Data

Oct. 23, 1990 [JP] Japan ..... 2-286675

[51] Int. Cl.[5] ..... F01B 3/00

[52] U.S. Cl. ..... 92/12.2

[58] Field of Search ..... 91/505, 506, 507; 92/12.2, 57, 70, 71

[56] References Cited

U.S. PATENT DOCUMENTS 4,294,139 10/1981 Bex et al. ..... 92/12.2

4,674,957 6/1987 Ohta et al. ..... 92/12.2

FOREIGN PATENT DOCUMENTS 60-175783 9/1985 Japan .

61-149585 7/1986 Japan .

*Primary Examiner*—John T. Kwon

*Assistant Examiner*—F. Daniel Lopez

*Attorney, Agent, or Firm*—Brooks Haidt Haffner & Delahunty

[57] ABSTRACT

A variable displacement compressor is disclosed having an improved pivotal mounting between its drive plate and the rotary journal that carries the swash plate. The pivotal mounting structure includes a bearing and a pin. The bearing is pivotally mounted on the drive plate. The pin couples the drive plate to the rotary journal. The pin is slidably mounted in a slot in the bearing so that when the bearing and rotary journal pivot, the pin may slide with in the slot. With this arrangement, the point at which a load from the journal is transferred to the drive plate remains substantially fixed regardless of the inclination angle of the journal.

12 Claims, 4 Drawing Sheets

VARIABLE DISPLACEMENT COMPRESSOR

This application claims the priority of Japanese Patent Application No. 2-286,675 filed on Oct. 23, 1990 which is incorporated herein by reference.

BACKGROUND OF THE INVENTION

1. Field of the Invention

The present invention relates generally to variable displacement compressors. More particularly, the invention relates to an improved mechanism for coupling a journal to a rotary drive plate in a variable displacement compressor.

2. Description of the Related Art

Variable displacement compressors have a wide variety of applications including use as compressors for air conditioning and/or refrigeration systems such as automotive air conditioners. A conventional variable displacement compressor is illustrated in FIG. 6. In this compressor, a rotary journal 103 is coupled via a link pin 102 to a drive plate 101, securely mounted to a rotary shaft 100. A swash plate 104 is supported by the journal 103. A plurality of cylinders 105 are provided in a cylinder block. Each cylinder receives a piston 106 that is coupled to the swash plate 104 by connecting rod 107. The rotary motion of the journal 103 causes undulating movement of the swash plate which in turn drive the connecting rods and pistons in a linear reciprocating manner.

An arc shaped elongated hole 109 is formed in a support arm 107 that protrudes from the drive plate 101. The elongated hole 109 serves as a guide that slidably holds the link pin 102. This arrangement keeps the top clearance of the piston 106 approximately constant at the top dead center position regardless of the inclination of the journal 103 and the swash plate 104. Thus, the inclination angle of the swash plate can be controlled to vary the stroke of the pistons.

When the accuracy of the dimensions of the arc-shaped, elongated hole 109 is low, however, the top clearance of the piston 106 cannot be maintained nearly constant. Therefore, when the gap between the elongated hole 109 and the link pin 102 is large, noise is generated. At present it is difficult to further improve the accuracy of the dimension of the elongated hole 109.

The discharge pressure of the compressor is generally higher than the crankcase pressure. Therefore, when a piston is in its top dead center position, the pressure of the gas in the compression chamber (acting against the face of the piston) will typically be higher than the pressure of the crankcase gases acting against the back side of the piston head. This creates a resultant compressive force which acts against the swash plate 104 at a point of action Mf.

In this design, the point where the journal supporting pin 102 contacts the elongated hole 109 in the drive plate 101 will vary in accordance with the inclination angle of the swash plate. More specifically, as the inclination angle of the swash plate 104 decreases, the point of support Mk of the compressive force moves downward in the elongated hole 109, as shown in FIG. 6. At the same time, the point of action Mf on the swash plate 104 which receives the compressive force of the piston 106 that has reached the top position moves upward relative to the point of support Mk.

As a result, the point of action Mf of the compressive force is not aligned with the point of support Mk. Thus, the compressive forces produce a moment that acts to influence (in this case further reduce) the inclination angle of the swash plate 104. This moment destabilizes the control of the compressor which makes smooth control of the compressor's discharge capacity difficult.

Another prior art variable displacement compressor design is disclosed in Japanese Unexamined Patent Application Publication No. 61-149585. In that design a drive arm is secured to the drive shaft for rotation therewith. The drive arm has a C-shaped hinge arrangement that is pivotally coupled to a mating C-shaped member carried by the swash plate. The drive arm is mounted to the drive shaft in a position that defines the top dead center position of the piston. Crankcase pressure can then be used to control the inclination angle of the swash plate to control the compressor's displacement.

Since the drive shaft and the swash plate are directly coupled by arcuate pivotal hinges, any compressive load acting on the piston located in the top dead center position will be transmitted directly through the swash plate to the drive arm. Thus, the compressive load acting on the top dead center piston will not influence the inclination of the swash plate. Further, since an arcuate hinge arrangement is used, the point at which the compressive load is transferred from the swash plate to the drive arm will remain fixed regardless of the swash plates inclination. Although this design avoids the effects of the compressive load of the top dead center piston affecting the inclination angle of the swash plate, the C-shaped hinge members necessary to couple the swash plate and drive arm are relatively difficult to produce.

SUMMARY OF THE INVENTION

It is therefore a primary object of the present invention to provide a variable displacement compressor which has an excellent controllability of the discharge capacity.

It is another object of this invention to provide a variable displacement compressor which can keep the top clearance of each piston approximately constant without raising problems, such as the generation of noise.

It is a further object of this invention to provide a variable displacement compressor which is easy to assemble.

To achieve these and other objects of the invention, an improved variable displacement compressor is provided. The compressor includes a housing having a cylinder block with a plurality of cylinders. A piston is disposed within each cylinder. A drive shaft rotatably mounted in the housing. A drive plate is mounted on the drive shaft such that it rotates integrally with the drive shaft. A rotary journal is pivotally coupled to the drive plate such that it rotates together with the drive plate. A swash plate is carried by the rotary journal for reciprocally driving the pistons to compress a fluid. The joint between the drive plate and the rotary journal includes a bearing and a pin. The bearing is pivotally mounted on the drive plate. The pin couples the drive plate to the rotary journal. The pin is slidably mounted in a slot in the bearing so that when the bearing and rotary journal pivot, the pin may slide with in the slot. With this arrangement, the point at which a load from the journal is transferred to the drive plate remains substantially fixed regardless of the inclination angle of the journal.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiment together with the accompanying drawings in which:

DETAILED DESCRIPTION OF THE PREFERRED EMBODIMENT

Figure 1:
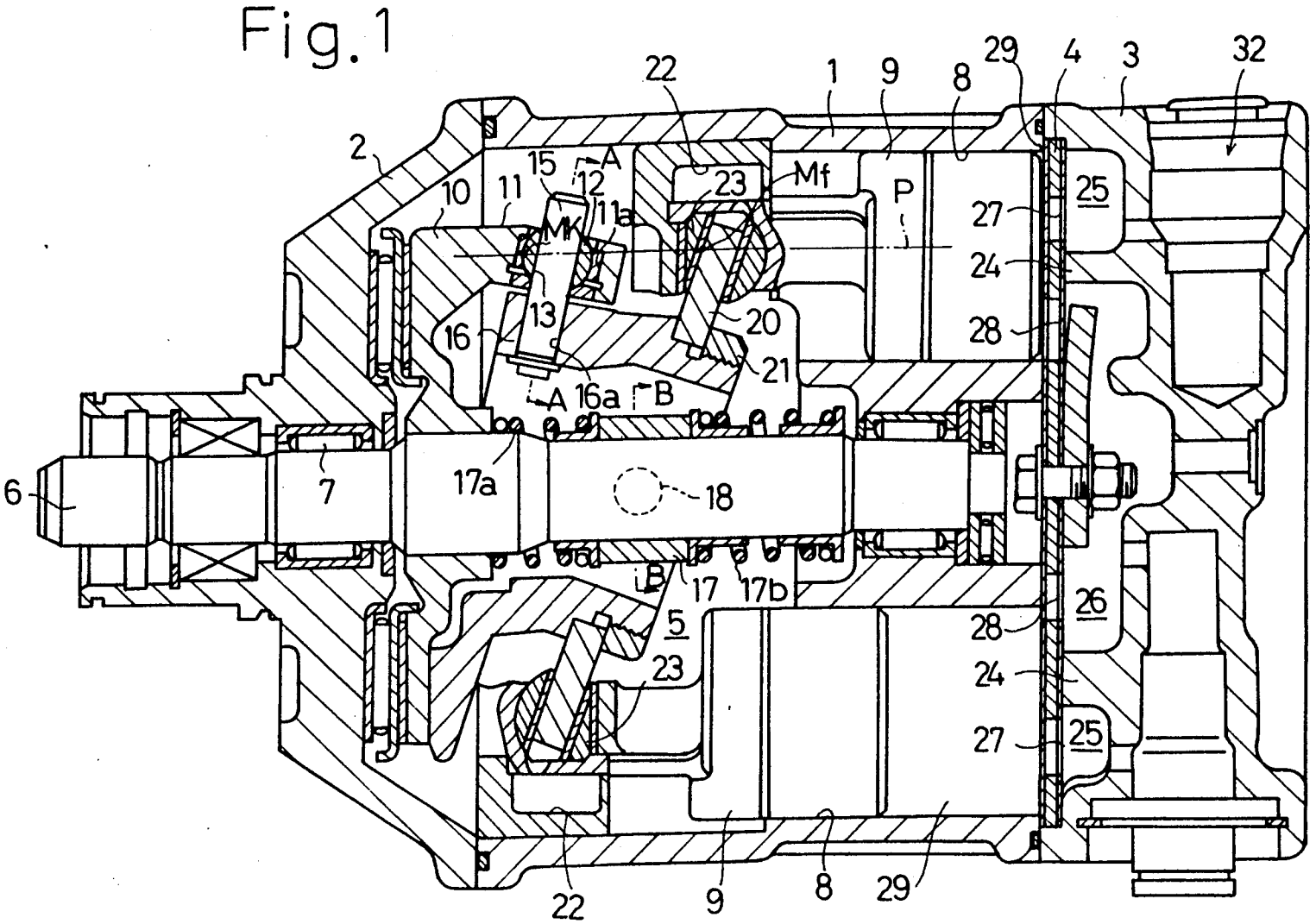
FIG. 1 is a side cross sectional view of a compressor embodying the present invention.

A preferred embodiment of the present invention will now be described referring to FIGS. 1 through 4. As shown in FIG. 1, the compressor has a cylinder block 1 having multiplicity of cylinder bores therein. A front housing 2 is connected to the front end of the cylinder block. A rear housing 3 is connected to the rear end of the cylinder block 1 with a valve plate 4 positioned therebetween. A drive shaft 6 is rotatably mounted in a crank chamber 5 defined by the cylinder block 1 and the front housing 2. The drive shaft 6 is rotatably supported by a pair of bearings 7.

The cylinder block 1 has a multiplicity of cylinder bores 8 arranged about the drive shaft 6. A piston 9 is slidably disposed in each cylinder bore 8. The centerline of each piston 9 is parallel to the axis of the drive shaft 6.

A drive plate 10 is mounted on the drive shaft 6 such that it is integrally rotatable therewith in the crank chamber 5. A substantially cylindrical journal 16 is attached to the back surface of the drive plate 10.

A support arm 11 is integrally formed with the drive plate 10 such that it faces the cylinders. The support arm 11 has an attachment hole 11*a* that houses a spherical bearing 12. The bearing 12 has a guide hole 13 formed therein. A pin 15 is slidably fitted within and supported by the guide hole 13. The lower portion of the pin 15 passes through an attachment hole 16*a* of the journal 16, and is securely attached to the journal. As will be explained below, this permits the journal 16 to be tilted forward and backward using bearing 12 as its pivot point.

Figure 3:
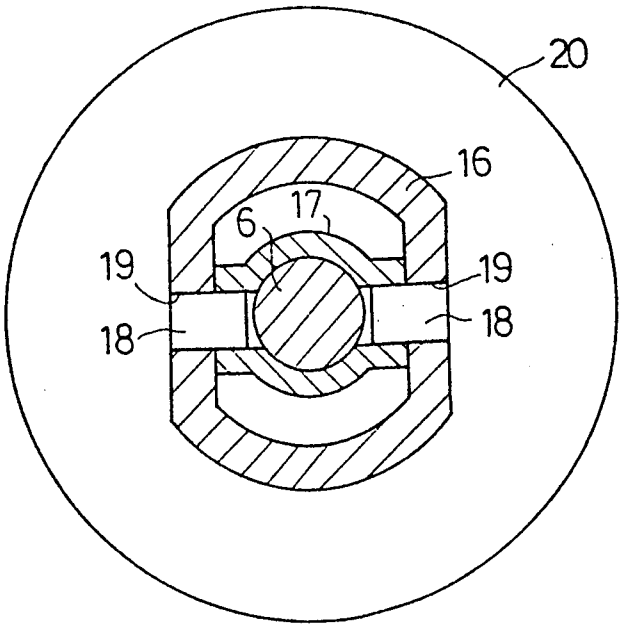
FIG. 3 is a front cross sectional view of showing a sleeve mechanism which rotatably supports the journal on the drive shaft.
Figure 2:
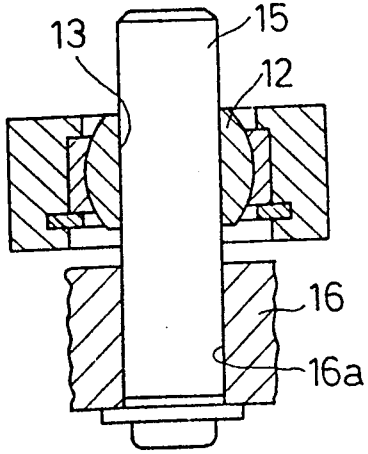
FIG. 2 is a partly cutaway, enlarged cross sectional side view of a joint mechanism that couples the drive plate to the rotary journal.

A sleeve 17 is slidably fitted over the drive shaft 6, and is biased in the front and back directions by compression springs 17*b* and 17*a* respectively. As shown in FIG. 3, shaft pins 18 extend from both sides of the sleeve 17 to engage holes 19 formed in the inner wall of the boss portion of the journal 16. This engagement permits the journal 16 to pivot about the shaft pins 18. When the swash plate inclines, the journal pivots about the shaft pin. At the same time, the pin 15 causes the bearing 12 to pivot while it slides relative to bearing 12 within the guide hole 13.

As seen in FIG. 3, the journal 16 is generally cylindrical in shape and is arranged to enclose the drive shaft 6. A swash plate 20 is secured to the outer surface of the journal by a fastening ring 21. Each piston 9 has a recess 22 on the end opposite the piston head. The swash plate 20 is fitted into the recesses 22 and is secured to the piston 9 by a shoe 23.

The rotational movement of the drive shaft 6 is converted into an undulating movement of the swash plate 20 through the drive plate 10, pin 15 and journal 16. The undulating movement is transmitted to each piston 9 through the sliding shoe 23, permitting the piston to reciprocate linearly in the cylinder bore 8.

The rear housing 3 includes an inlet chamber 25 and a discharge chamber 26 which are separated by a partition 24. An inlet port 27 and a discharge port 28 are formed in the valve plate 4 in association with each cylinder bore 8. Compression chambers 29 formed between the valve plate 4 and each piston 9 communicates with the inlet chamber 25 and discharge chamber 26 respectively through the inlet ports 27 and discharge ports 28. An inlet valve and a discharge valve are respectively disposed in each inlet port 27 and each discharge port 28 to open and close the inlet port 27 and discharge port 28 in accordance with the reciprocal motion of the piston 9.

A coolant gas sucked into the compression chamber 29 from the inlet chamber 25 by the reciprocal motion of the piston 9 is compressed and is discharged into the discharge chamber 26. During compression, the pressure acting on the end face of each piston head varies between the inlet pressure and the discharge pressure in accordance with the suction and discharge processes of each piston 9. When the piston compresses a gas the resultant compressive force that acts on the piston face is transmitted from the associated shoe 23 to the swash plate 20. The compressive force is a function of the difference between the pressure acting on the end face of each piston 9 and the pressure in the crank chamber 5 which acts on the back of the piston 9. A conventional electromagnetic type control valve mechanism 32 controls the pressure in the crank chamber 5. The crank pressure is then used to control the inclination angle of the swash plate.

It is noted that if the compressive force of a piston at its top dead center position produces a moment that acts on the swash plate 20, it would affect the swash plate's inclination angle. Such a change in inclination angle would alter the stroke of the piston 9. In the rear housing 3 is provided an electromagnetic type capacity control valve mechanism 32 which controls the pressure in the crank chamber 5.

The resultant compressive force of a piston at its top dead center position acts on the swash plate 20 at a point Mf. Since the swash plate 20 is effectively supported by the arm 11 through the journal 16, pin 15 and bearing 12, the compressive force effectively acts on the arm 11 at point Mk, where the bearing 12 contacts the arm 11.

According to this embodiment, the pin 15 is supported by the spherical bearing 12 which is pivotally mounted on the arm 11 of the drive plate 10. Therefore, when the inclination angle of the swash plate 20 changes, the point of support Mk of the compressive force on the bearing 12 does not vary. Accordingly, the point of action Mf of the compressive force on the swash plate 20 corresponding to a piston 9 positioned at its top dead center position and the point of support Mk can be set on the same imaginary plane P that includes the centerline of the piston 9.

It is thus possible to prevent the compressive force acting against a piston positioned at its top dead center from influencing the inclination angle of the swash plate. This makes it easier to more smoothly control the inclination angle of the swash plate 20 by controlling crankcase pressure. Thus, the discharge capacity of the compressor may be significantly enhanced.

Even when the pin 15 is inclined with respect to the spherical bearing 12 due to production errors, the attachment would be carried out smoothly because the bearing 12 has a degree of freedom that allows for such inclination.

The present invention is not limited to the above-described embodiment, and may be modified in various other manners within the scope and spirit of this invention. For instance, this invention may be modified in the following manners.

Figure 4:
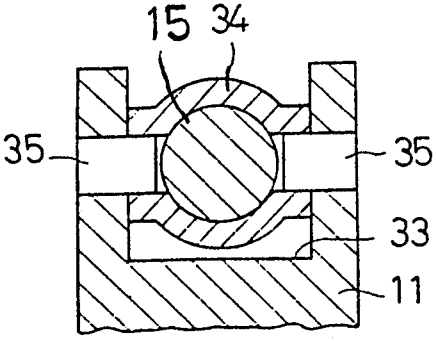
FIG. 4 is a cross sectional view of an alternative embodiment of the journal supporting mechanism.

In the described embodiment, a spherical bearing was used to couple the pin 15 to the support arm 11. However, as shown in FIG. 4, this arrangement may be simplified by forming an engagement recess 33 is formed in the distal end portion of the support arm 11. A cylindrical bearing 34 is then mounted pivotally in the recess 33 by a pair of link pins 35. The pin 15 may then be inserted into a guide hole 34*a* formed in the cylindrical bearing 34. This arrangement is easier to produce than designs that employ a spherical bearing 12.

Figure 5:
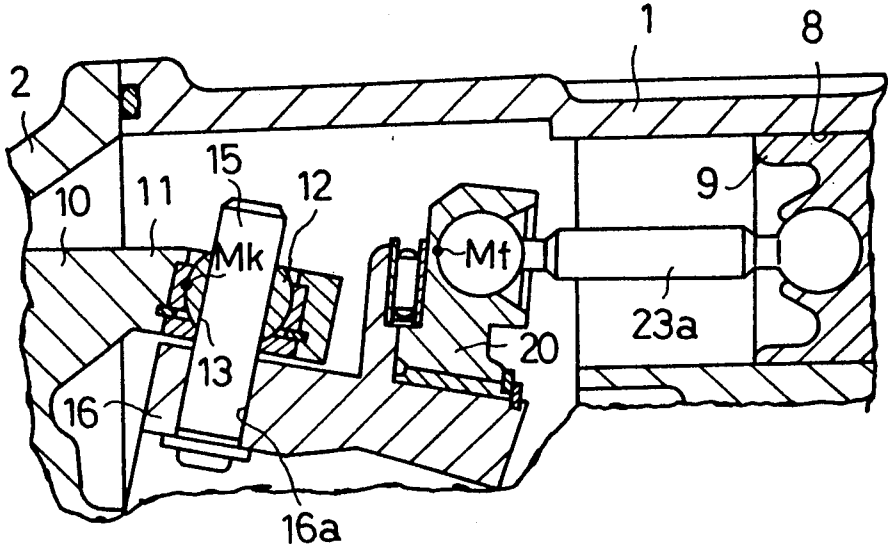
FIG. 5 is a partial cross sectional side view of an alternative embodiment of the invention which uses the same journal mounting structure with a compressor that uses connecting rods to couple the swash plate to the pistons.
Figure 6:
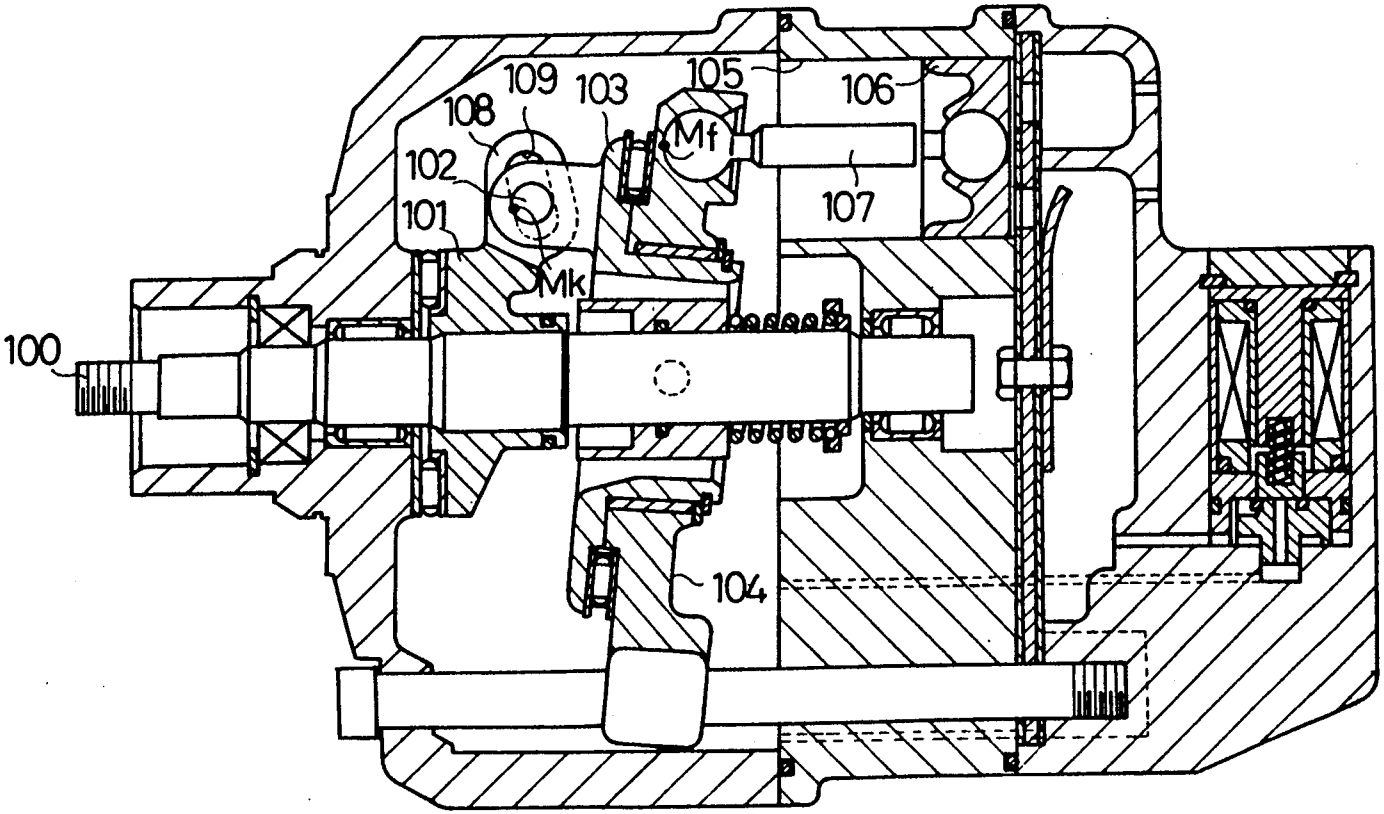
Fig. 6 (PRIOR ART)
FIG. 6 is a side cross sectional view of a conventional variable displacement compressor.

Further, in the above described embodiment, a plurality of sliding shoes 23 are used to couple the swash plate 20 to the pistons 9. As shown in FIG. 5, conventional connecting rods 23*a* may be used in place of the shoes. In this case, the point were the journal is supported by the drive plate is again fixed. However, the point were the compressive force Mf acts on the swash plate shifts somewhat. Thus some moments may be generated that will influence the inclination angle of the swash plate 20. However, when compared with the prior art in which the point of support Mk and the point of action Mf are set apart from each other, the degree of the deviation is small and the rotational moment acting on the swash plate 20 can be properly suppressed.

What is claimed is:

1. A variable displacement compressor comprising:

a housing including a cylinder block having a plurality of cylinders;

a plurality of pistons each piston being disposed in an associated cylinder;

a drive shaft rotatably mounted in the housing;

a drive plate mounted on the drive shaft such that it rotates integrally with the drive shaft;

a rotary journal pivotally coupled to the drive plate such that it rotates together with the drive plate;

a swash plate carried by the rotary journal for reciprocally driving the pistons to compress a fluid;

a bearing pivotally mounted on the drive plate; and a pin for coupling the drive plate to the rotary journal, the pin being slidably supported by said bearing when said rotary journal pivots, the pin and bearing being arranged such that a point $M_k$ at which a load generated by a pressure acting against a selected piston in a top dead center position is transferred from the journal to the drive plate remains substantially fixed regardless of the inclination angle of the journal.

2. A compressor as recited in claim 1 further comprising a plurality of shoes that slidably receive the swash plate, each shoe being associated with a particular piston for reciprocating the pistons in their associated cylinders based on the movements of the swash plate.

3. A compressor according to claim 1, further comprising a plurality of connecting rods for coupling the pistons to the swash plate, each connecting rod being associated with a particular piston.

4. A compressor as recited in claim 1 wherein when the selected piston is in the top dead center position, a point $M_f$ where the effective load generated by the pressure acting against the selected piston is transferred to the swash plate is substantially aligned with the point $M_k$ where the load from the journal is transferred to the drive plate.

5. A compressor as recited in claim 4 wherein point $M_f$ and point $M_k$ are aligned such that the line therebetween is substantially parallel to a rotational axis of the drive shaft.

6. A compressor as recited in claim 1 wherein the bearing has a guide slot therein that slidably receives the pin.

7. A compressor as recited in claim 1 wherein the bearing is a spherical bearing.

8. A compressor as recited in claim 1 wherein the bearing is a cylindrical bearing.

9. A variable displacement compressor comprising:

a housing including a cylinder block having a plurality of cylinders;

a plurality of pistons each piston being disposed in an associated cylinder;

a drive shaft rotatably mounted in the housing;

a drive plate mounted on the drive shaft such that it rotates integrally with the drive shaft;

a rotary journal pivotally coupled to the drive plate such that it rotates together with the drive plate;

a swash plate carried by the rotary journal for reciprocally driving the pistons to compress a fluid;

a bearing pivotally mounted on the drive plate, the bearing being selected from the group including spherical and cylindrical bearings; and a pin for coupling the drive plate to the rotary journal, the pin being slidably supported by the bearing, the pin and bearing being arranged such that when the rotary journal pivots with respect to the drive plate, the pin slides linearly in the guide slot and said bearing pivots relative to the drive plate, the pin and bearing being arranged such that a point at which a load from the journal is transferred to the drive plate remains substantially fixed regardless of the inclination angle of the journal.

10. In a variable displacement compressor having a plurality of pistons disposed in a cylinder block, a rotatable drive shaft, a drive plate mounted on the drive shaft such that it rotates integrally with the drive shaft, a rotary journal pivotally coupled to the drive plate such that it rotates together with the drive plate and a swash plate carried by the rotary journal for reciprocally driving the pistons to compress a fluid, the improvement comprising:

a bearing pivotally mounted on the drive plate, the bearing having a guide slot; and a pin for coupling the drive plate to the rotary journal, the pin being slidably supported by the bearing, the pin and bearing being arranged such that when the rotary journal pivots with respect to the drive plate, the pin slides linearly in the guide slot and said bearing pivots relative to the drive plate.

11. A compressor as recited in claim 10 wherein said bearing is a cylindrical bearing.

12. A compressor as recited in claim 10 wherein said bearing is substantially a spherical bearing.

* * * * *